US008465063B1

(12) United States Patent
Jones et al.

(10) Patent No.: US 8,465,063 B1
(45) Date of Patent: Jun. 18, 2013

(54) GATE LATCH APPARATUS AND METHODS OF USE

(76) Inventors: Gregory F. Jones, Alsea, OR (US); Scottie B. Jones, Alsea, OR (US)

( * ) Notice: Subject to any disclaimer, the term of this patent is extended or adjusted under 35 U.S.C. 154(b) by 1439 days.

(21) Appl. No.: 11/699,141

(22) Filed: Jan. 29, 2007

Related U.S. Application Data

(60) Provisional application No. 60/773,186, filed on Feb. 14, 2006.

(51) Int. Cl.
*E05C 17/36* (2006.01)

(52) U.S. Cl.
USPC ..... 292/264; 292/265

(58) Field of Classification Search
USPC ..... 292/264, 265–272
See application file for complete search history.

(56) References Cited

U.S. PATENT DOCUMENTS

| | | | | |
|---|---|---|---|---|
| 3,720,431 | A | | 3/1973 | Oliover et al. |
| 4,193,584 | A | | 3/1980 | Wieser |
| 4,254,975 | A | | 3/1981 | Miller |
| 4,305,611 | A | | 12/1981 | Robins |
| 4,355,829 | A | | 10/1982 | Gregory |
| 4,512,105 | A | | 4/1985 | Norton |
| 4,560,191 | A | * | 12/1985 | Grassi ..... 292/264 |
| 4,871,203 | A | | 10/1989 | Rogers |
| 4,923,231 | A | | 5/1990 | Bergman et al. |
| 5,020,840 | A | | 6/1991 | Winter |
| 5,063,876 | A | | 11/1991 | Harris |
| 5,226,684 | A | | 7/1993 | De La Garza |
| 5,284,370 | A | | 2/1994 | Dunn |
| 5,358,292 | A | | 10/1994 | Van Wiebe et al. |
| 5,651,333 | A | | 7/1997 | Fisher |
| 5,868,446 | A | | 2/1999 | Rossmo |
| 5,964,548 | A | | 10/1999 | Adkins et al. |
| 6,017,068 | A | | 1/2000 | Hughes |
| 6,422,613 | B1 | | 7/2002 | Boroviak |
| 6,425,612 | B1 | | 7/2002 | Schaeffer |
| 6,752,438 | B2 | | 6/2004 | DeSouza |
| 6,840,194 | B2 | | 1/2005 | Young |
| 6,898,953 | B1 | | 5/2005 | Paprocki et al. |

OTHER PUBLICATIONS

Northern Industrial 1-Way Lockable Livestock Gate from web site www.hardentoolstore.com.
Halo Hook gate/door chain latch from web sitw www.halo-hook.com.
Quick Latch Gate Latch from web site www.pbsanimalhealth.com.
Red River Portable Arenas from web site www.redriverarenas.com.
"Secure Latch" A new safer livestock gate latch from web site www.wolfpawquarterhorses.com.

(Continued)

*Primary Examiner* — Carlos Lugo
*Assistant Examiner* — Mark Williams
(74) *Attorney, Agent, or Firm* — William A. Birdwell

(57) ABSTRACT

The invention relates to a device and methods for installing and using a gate latch apparatus to protect and enclose livestock. The latching device may or may not be permanently installed, and it can be installed on gates in both a horizontal and vertical fashion. The gate latch apparatus can be opened with one hand of a person. The apparatus includes a pair of latch plates with two chain-grasping slots. The ability to double latch the gate is possible by sliding the chain into both the first and second slots of an L-shaped slot and wrapping the chain across the fitted member and then slipping the chain into a U-shaped slot. The gate latch of this invention can also be used to attach two gates together and to attach free standing fence panels together.

7 Claims, 6 Drawing Sheets

OTHER PUBLICATIONS

RAMM Fencing—Stalls—Solutions from web site www.rammfence.com.

Noble Latches/Hinges from web site www.noblepanels.com.

New and Used Gate Latch, five pages of eBAY results from search done Oct. 11, 2006.

* cited by examiner

GATE LATCH APPARATUS AND METHODS OF USE

CROSS REFERENCE TO RELATED APPLICATION

This application claims the benefit of priority of provisional U.S. Patent Application No. 60/773,186, filed on Feb. 14, 2006 which is hereby incorporated by reference in its entirety.

BACKGROUND OF THE INVENTION

1. Field of the Invention

The present invention relates to latching devices and, more specifically, to a pair of latch plates that fit on the gates of an area that encloses animals. The latch plates are engaged and disengaged by a person by hand with the optional use of a wrench. Furthermore, the pair of latch plates may or may not be permanently installed. Still further, the latch plates cannot be opened by either the force or cleverness of an enclosed animal.

2. Background and Related Art

There are many ways to latch a livestock gate, but often the latches are either too expensive to add to every gate or are weak and prone to failure when pushed by livestock. In the past, latches often were affixed to the latching post. Applicant's gate latch apparatus affixes to the gate itself.

Many livestock gates are sold with a simple change and clip latching device. The clip is a simple solution to keep the gate shut, but is weak and prone to failure when large animals push against it. The clip can be easily bent or broken. The chain, which is designed to be stapled to a post often pulls out; thus opening the gate and allowing livestock to escape.

In terms of human interaction, a typical prior art clip mechanism requires two hands to open it as it clips back on itself with a chain. Once the clip has been through a season of rain or snow; it may become stiff, making it difficult to open at all, since it tends to freeze in position.

Stock gates are used to assist in livestock control, not only in paddock areas, but also to keep livestock out of agricultural growing fields, thus protecting animals and crops. In this invention, "livestock" will mean typical and exotic farm animals. Typical farm animals include cows, horses, sheep, goats, pigs and the like. In this invention, exotic animals include llamas, alpacas, deer, ostriches and the like. Livestock gates, on their own, provide protection from escape by livestock through the use of horizontal bars or wire-filled panels; however, this is a moot point if the gate latch fails or if the gate latch is opened by the mouth of a nimble animal.

Ease of gate operation is an important consideration in the field of latching and unlatching farm gates. Farmers and ranchers often have one hand already in use when passing through these gates (e.g., holding the reins of a horse they are riding, holding the steering wheel of an ATV; leading an animal, etc.). Being able to open a gate from either side with ease, and with one hand of the farmer or rancher, is a distinct advantage of the present invention in terms of the farmers' or ranchers' time and safety.

Another use for the gate latch apparatus of this invention is for free-standing fence panels where conventional latching devices do not work because of uneven terrain. Free standing fence panels are collapsible and are not permanently mounted, but are instead installed temporarily. Livestock pens and confinement stalls are well known in the farm and ranch industry.

Portable and temporary stalls are used to work with cattle, sheep, horses, and other domesticated animals. This type of device is often used in temporary situations to vaccinate animals or to separate certain ones from a group for a special purpose such as cleaning, worming, or birthing.

The gate latch apparatus of the instant invention is useful for confining animals in free-standing fence configurations to keep livestock safely and securely contained therein while they are used in the special confinement situations described above.

Finally, many of the strong latches on the market today require the latching post to be a certain distance from the gate end in order to be fastened properly. As new gates are often replacements for damaged gates, there can be quite a variation in where the latching posts sit and sinking a new post at the perfect distance is often problematic.

Prior patents relating to latching farm gates include U.S. Pat. No. 4,254,975 to Miller, U.S. Pat. No. 6,898,953 to Papocki et al, U.S. Pat. No. 6,752,438 to DeSouza, U.S. Pat. No. 6,425,612 to Schaeffer, U.S. Pat. No. 6,422,613 to Boroviak, U.S. Pat. No. 6,017,068 to Hughes, U.S. Pat. No. 5,868,446 to Rossmo, U.S. Pat. No. 5,358,292 to Van Wiebe et al, U.S. Pat. No. 5,284,370 to Dunn, U.S. Pat. No. 5,226,684 to De La Garza, U.S. Pat. No. 5,020,840 to Winter, U.S. Pat. No. 4,923,231 to Bergman et al, U.S. Pat. No. 4,871,203 to Rogers, U.S. Pat. No. 4,512,105 to Norton, U.S. Pat. No. 4,355,829 to Gregory, U.S. Pat. No. 4,305,611 to Robins, and U.S. Pat. No. 3,720,431 to Oliver et al.

None of these prior patents use a simple yet strong, steel design that is the design of the instant invention. The instant invention can be latched in two different directions on any bar of a farm gate. The gate latching device of the present invention is simple to attach, requiring only two bolts and does not require the latching post to be at a specific distance from the end of the gate. It is stronger than the clip latches now being sold for this purpose, is versatile in positioning and offers a double latching mechanism for animals that are prone to opening gates with their mouths.

Prior attempts at meeting the needs of a successful farm gate latch may have one or two characteristics of the gate latch apparatus of the instant invention, but not all of them as presented herein.

Patents concerned with free-standing fence panels include U.S. Pat. No. 5,651,333 to Fisher, U.S. Pat. No. 5,063,876 to Harris, and U.S. Pat. No. 4,193,584 to Wieser. U.S. Pat. No. 7,121,529 to Priefert, U.S. Pat. No. 6,840,194 to Young, and U.S. Pat. No. 5,964,548 to Atkins et al. All of these patents are concerned with methods for locking fence panels together.

None of these prior patents use a removable latch that can be affixed on any bar of a fence panel and use a method to secure the panels together with a chain secured by the gate latch of the present invention. The gate latching device of the present invention is simple to attach, requiring only two bolts for said attachment, and does not require the fence panels to be lined up exactly with each other to be fastened together by the gate latch of the present invention. Other solutions may have one or two characteristics of the gate latch apparatus of the instant invention, but not all of them.

SUMMARY OF THE INVENTION

The gate latch apparatus of the current invention comprises a pair of attachable, inflexible metal latch plates for a gate that can be attached in both a vertical manner by bolting to a horizontal rung bar of a gate and a horizontal manner by bolting to a vertical frame bar of a gate of an area used to enclose animals that is a pair of matching, mirror image members that includes:

a) a first rectangular-shaped member that contains a hole that accepts a bolt that is positioned for attachment to a bar of a gate and a U-shaped slot that is directed so that the opening of the U-shaped slot is positioned away from the bolt hole and is able to accept a chain that ranges in length of from about 12 inches to about 36 inches, said first rectangular member is adjacent to b) a fitted member that contains a second hole in its middle that can accept a screw for added security and extends to match the bend of the gate bar to which it is attached and that is adjacent to c) a triangular-shaped member contains a third hole that accepts a bolt for attachment to the gate bar of said gate so that the pair of latch plates meet and are bolted onto the gate bar and an L-shaped slot that is directed so that the opening of one of the two slots of the L-shape is positioned away from the third bolt hole and is able to accept a chain and the second of the two slots of the L-shaped slot is positioned inwards in the triangular member and the chain is inserted by a person into the opening of the L-shaped slot that accepts the chain, and then the person moves it into the inward-positioned L-shaped slot, and then the person wraps the chain across the fitted member and then it is slid into the U-shaped slot for attachment and closure of the pair of latch plates and closes the gate.

The gate latch of this invention can be opened with one hand by a person while standing on the ground or on horseback. It may be tightened onto the gate by hand, but requires a wrench to install the gate latch tightly enough to keep from moving under the weight of large livestock. The latch provides durability, ease of application and use, and is unable to be opened by an inquisitive or charging animal. It has versatile positioning and is inexpensive, suitable for a rural farm and ranch economy.

The gate latch apparatus of this invention only requires two bolts for installation and provides an easy solution for livestock control on farms and ranches. The gate latch apparatus of this invention can be used with a variety of chains which can be either stapled or wrapped around the latching post. It is even possible to latch two gates together with the present invention, where the latch is on one of the gates, with one of the chain ends held under a bolt, and the remainder of the chain wrapping around the second gate and sliding back into the latching device. This is similar to the latching technique of this invention used for free standing panels, where instead of the panels being hung on gate posts, the panels support each other, and can be fixed together with the gate latch of this invention, often in a circle or other geometrical shape as shown in FIG. 6.

Some of the prior art solutions required a specific distance to the latching post and also required a gate to not sag or else the latching is difficult. In addition, the double latch of this invention provides extra strength and safety around animals prone to opening gates with their mouths.

DEFINITIONS USED IN THIS INVENTION

Figure 1:
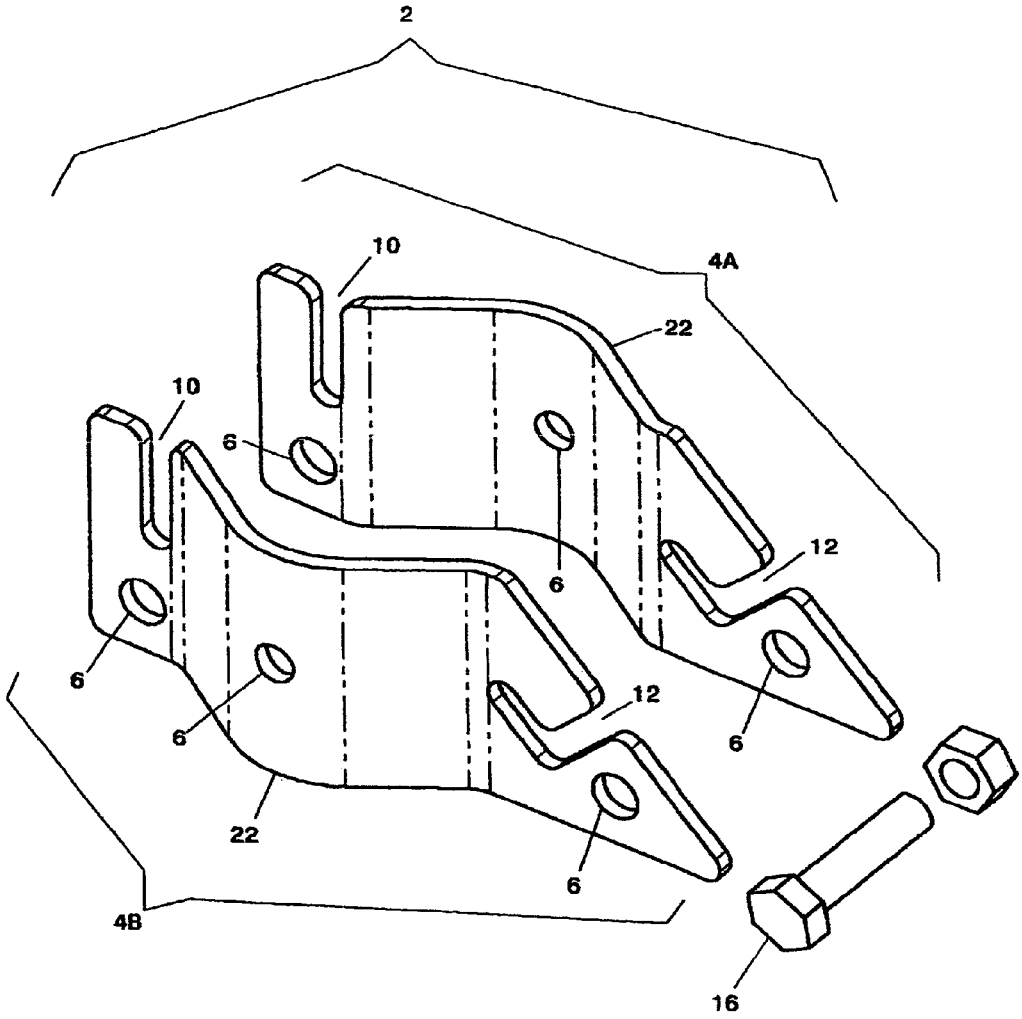
FIG. 1 is a diagram of the two mirror image halves of the gate latch apparatus of this invention and depicts its distinctive features.

In the present invention, a livestock gate means a gate used to control the access of farm and ranch livestock.

In the present invention, the horizontal rung bars are the bars that run horizontally to make up the barrier section of the gate. There are often four or five of these in a gate depending on the size of the gate and the needs of the farmer or rancher.

In this invention, the vertical frame bars are the bars on either end of the gate that hold the horizontal rung bars in place and act to stabilize the gate. The vertical frame bars are used on one side to attach the gate to a gate post (called 'hanging" a gate) and on the other side for latching purposes.

In this invention, the latching post is the post to which the gate is latched. As latches are not meant to be permanently closed, this post allows for the gate to be opened and closed by a person.

In this invention, double-latching will mean sliding the chain into the L-shaped slot and wrapping the chain across the fitted member and then slipping the chain into the U-shaped slot.

In this invention, the term "fitted" is used herein to describe the shape of the central member of the latch of this invention. The fitted member of the gate latch apparatus of this invention is custom fitted to the piece of gate to which it is attached.

In this invention, plastic is used as an all-encompassing term to cover fencing made of a synthetic polymer. Currently, the plastic fencing most common in the livestock industry is known as vinyl fencing.

In this invention, wire-filled panels mean panels of woven or welded wire mesh with openings no larger than 2"×4" that may be added to gates.

DETAILED DESCRIPTION OF THE PREFERRED EMBODIMENTS

The need to enclose and protect farm animals is well-known and attempts to achieve this have been numerous. With the increasing number of hobby farms, there is now need for a non-welded solution for those gates sold without the use of pre-welded hooks or slots. Until this invention, people have made due with the provided clip and chain on their farm and ranch gates, but many have been unsuccessful.

A typical livestock gate used on a small ranch or farm measures from about four feet to about twenty feet wide to allow passage of animals at one time. The gates also allow entrance of vehicles and machinery used for farm and ranch work. Livestock gates measure generally from about four to about six feet tall. They are primarily made of metal, wood, plastic, and any combination of these materials.

In this invention, the farm gates can be made of metal, word or plastic. The particular metal is not important as any metal that is used in building fences is a suitable construction material for the gate latch apparatus of this invention. The metal used should be galvanized, zinc-plated, electroplated, or powder coated for protection from the occurrence and build-up of rust and inclement weather on the latch plates. Adaptation of the latch components, specifically the fitted member 22 will be modified as needed by a particular construction material.

With reference to the Figures of this invention, the two halves of the gate latch apparatus (4*a* and 4*b*) are similar to a pair of left- and right-hands which are non-super imposable mirror images of each other. In this manner, they are wrapped around a gate bar 28 or frame bar 30 and latched with a chain 14 to a latching post 20 of an area used to enclose animals.

Features shown in the Figures include a first rectangular-shaped member that contains a hole 6 that accepts a bolt 16 that is positioned for attachment to a bar of said gate 18 and a U-shaped slot 10 that is directed so that the opening of the U-shape 10 is positioned away from the bolt hole 6 and is able to accept a chain 14 that ranges in length of from about 12 inches to about 36 inches. Said rectangular member is adjacent to a fitted member that contains a second hole 6 in its middle and whose bend matches the bend of the gate to which it is attached. Said fitted member is adjacent to a triangular-shaped member that contains a third hole 6 that accepts a bolt for attachment to the gate 18 and an L-shaped slot 12 that is directed so that the opening of one of the two slots of the L-shaped slot 12 is positioned away from the third bolt hole 6. The L-shaped slot 12 of the triangular-shaped member is cut midway in the hypotenuse of the triangular member and is internally bent at a 45 degree angle. The L-shaped slot 12 has two sides which are equal in length.

Figure 2:
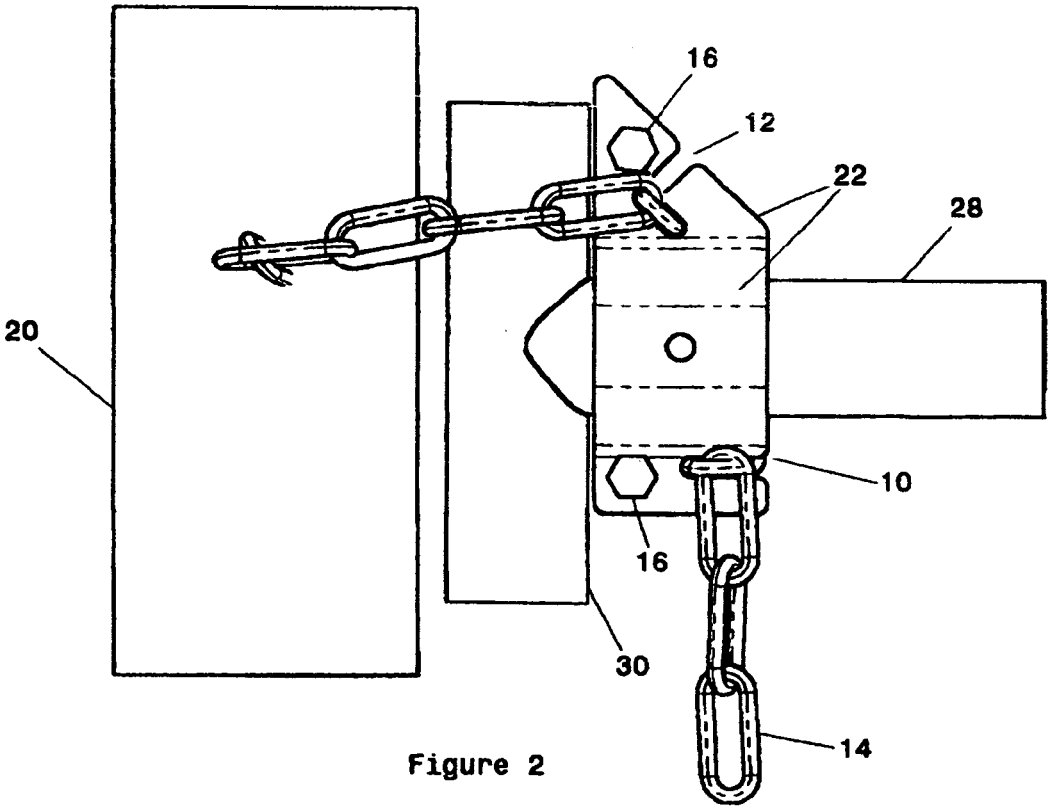
FIG. 2 shows the gate latch of this invention installed and latched with a chain in a vertical fashion on a gate bar, approximately 2" from the latching post.
Figure 3:
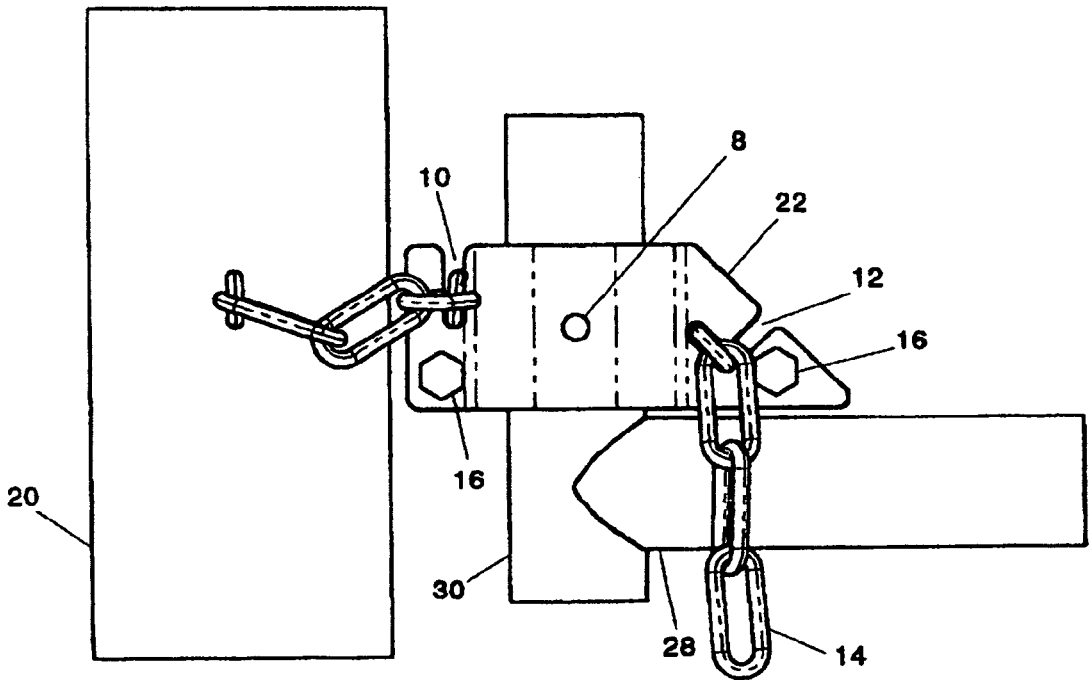
FIG. 3 depicts the gate latch of this invention installed and latched with a chain in a horizontal fashion on a gate bar, approximately 6" from the latching post.
Figure 4:
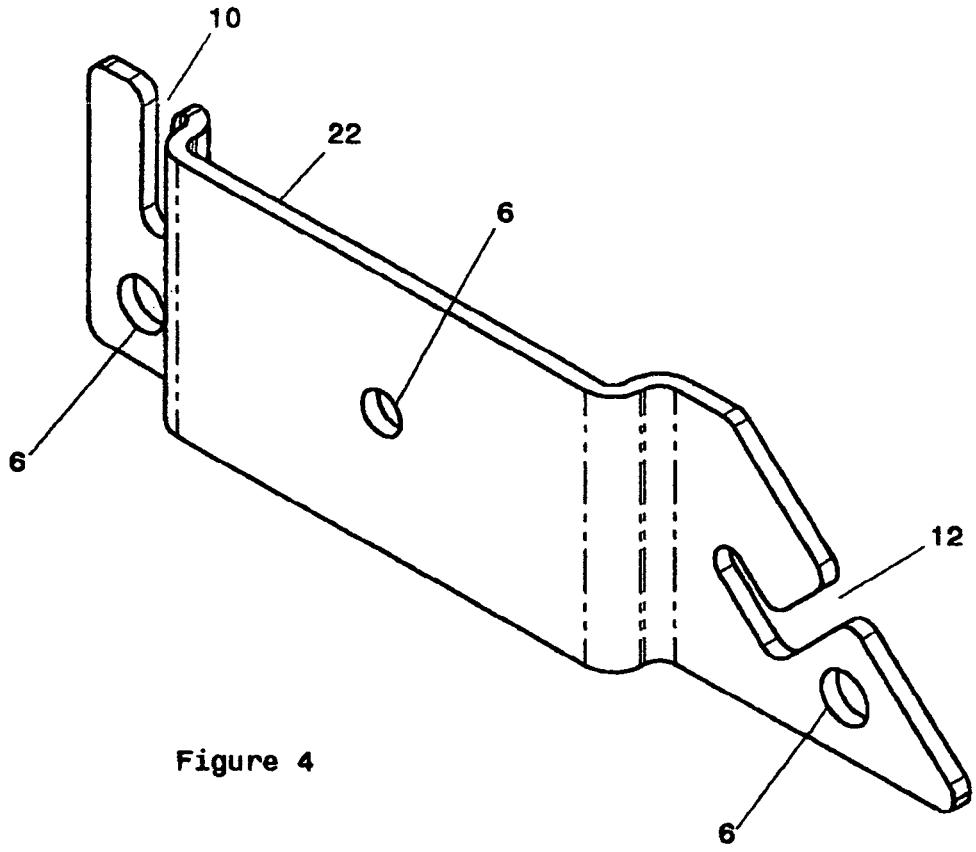
FIG. 4 depicts a flat fitted version of the gate latch apparatus of this invention.
Figure 5:
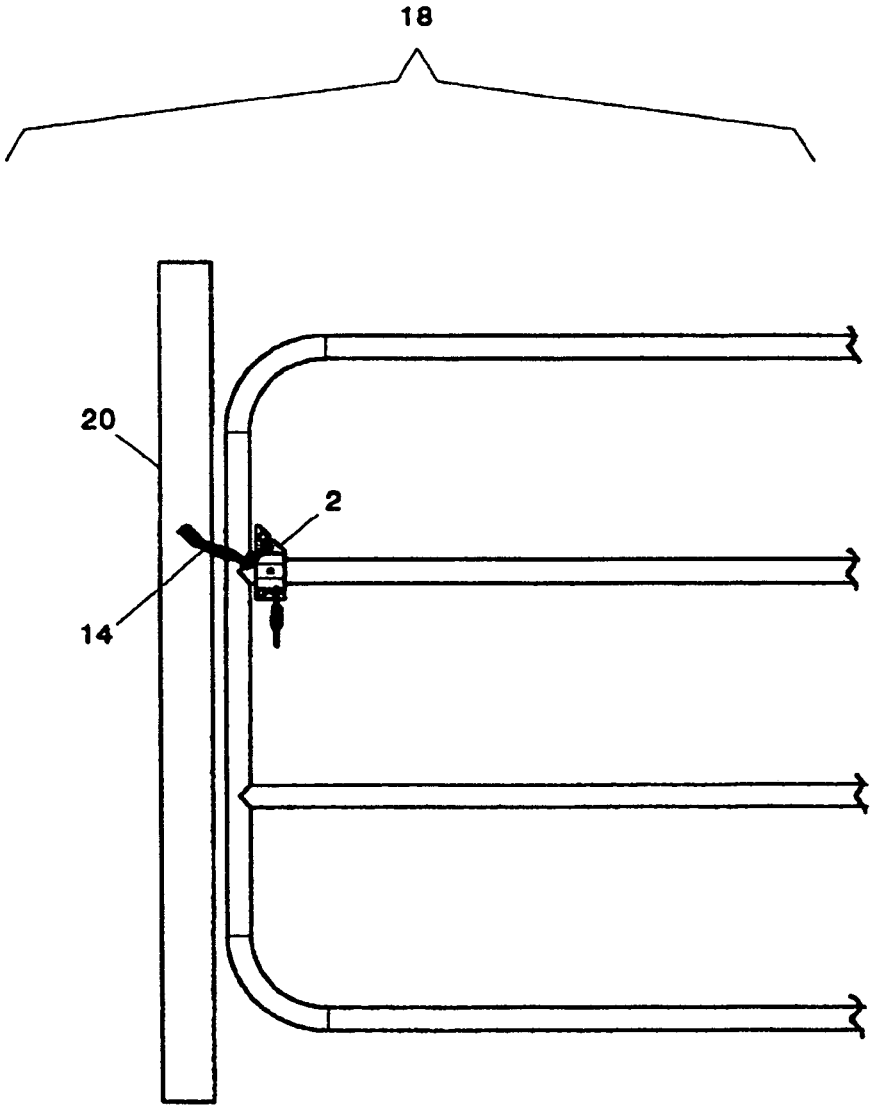
FIG. 5 shows the gate latch apparatus of this invention installed on a gate, providing an overview of how it is placed in an actual farm or ranch setting.

Features shown in FIGS. 2 and 3 include the first side of the L-shaped slot 12 is firstly able to accept a chain 14 and the second of the two slots of the L-shaped slot 12 that is positioned inwards in the triangular member secondly accepts the chain 14 so that the pair of latch plates 4*a* and 4*b* meet and are bolted onto the gate 18. To lock the gate latch 2, the chain 14 is inserted by a person into the first opening of the L-shaped slot 12 that accepts the chain 14, and then moves it into the inward-positioned second L-shaped slot 12, and then the person wraps the chain 14 across the fitted member 22 and then it is slid into the U-shaped slot 10 of the rectangular member for attachment and closure of the pair of latch plates 4*a* and 4*b* and closes the gate 18.

The gate latch members 4*a* and 4*b* comprising the gate latch apparatus 2 can be unlatched and opened with one hand by a person while standing on the ground, holding the reins of a horse s/he is riding; holding the steering wheel of an ATV; leading an animal, and the like. Being able to open a latched gate from either side, with ease and with one hand, is a distinct advantage in terms of time and safety that is provided by the gate latch apparatus 2 of this invention.

Specific details of the gate latch apparatus 2 of the instant invention include the dimensions of each member. Dimensions for the U-slot 10 and each half of the L-shaped slot 12 are that they are one inch in length and ¼ inch wide. On the gate 18 the gate latch apparatus 2 is approximately 5½ inches long and 2 inches wide. It is bolted onto the gate 18.

The bolt 16 is 0.25" by 1.25", and the bolt hole is ⅜ inch in diameter. Further details and measurements for a tubular gate include the bars of the gate 18 are about 1⅜-2 inches in diameter. For wood and plastic gates, the length of the latch sizes will be about 20% larger. The shape of the gate bars can be circular, square, rectangular or flat. It should be understood that the stated measurements are provided for the sake of complete description of the preferred embodiment; variations of these dimensions that do not alter substantively from those recited herein are meant to be considered part of this invention as well.

When not in use, the chain 14 can be taken off the gate latch apparatus 2, removed completely, stapled to the latching post 20, or secured under the bolt 16 that attaches the gate latch apparatus 2 to the gate 18. To provide additional protection and a stronger barrier to livestock escape, the gate latch apparatus 2 can be double-latched. In this invention, double-latching will mean sliding the chain 14 into the L-shaped slot 12 and wrapping the chain 14 across the fitted member 22 and then slipping the chain 14 into the U-shaped slot 10. The hole 6 in the middle of the fitted member is used to permanently attach the device 2 to a gate 18. The gate latch apparatus 2 of this invention is preferably made of metal. The metal used should be galvanized, zinc-plated, electroplated, or powder coated, or protected from the occurrence and build-up of rust and inclement weather on the latch plates. Adaptation of the latch components, specifically the fitted member 22 will be modified as needed by a particular construction material.

As shown in FIGS. 2 and 3, the gate latch apparatus 2 of this invention can be installed either vertically or horizontally. FIG. 2 depicts the gate latch apparatus 2 mounted in a vertical manner on the gate 18 and latched with a chain 14 and is the preferred directional method if livestock are being kept in or out with the gate because of its safety factor. This is because in this position, the gate latch 2 does not extend past the end of the gate 18 and increases the difficulty for an animal to unlatch the chain 14 in this position.

FIG. 3 shows an alternative horizontal positioning of the gate latch 2 if animals are not an issue. If desired, only one of the two slots need be used for easy, quick latch and release of the chain. Both FIGS. 2 and 3 show the double latching possibilities with the L-shaped slot 12 on one side and the U-shaped slot 10 on the other side, with the chain 14 engaged.

Figure 6:
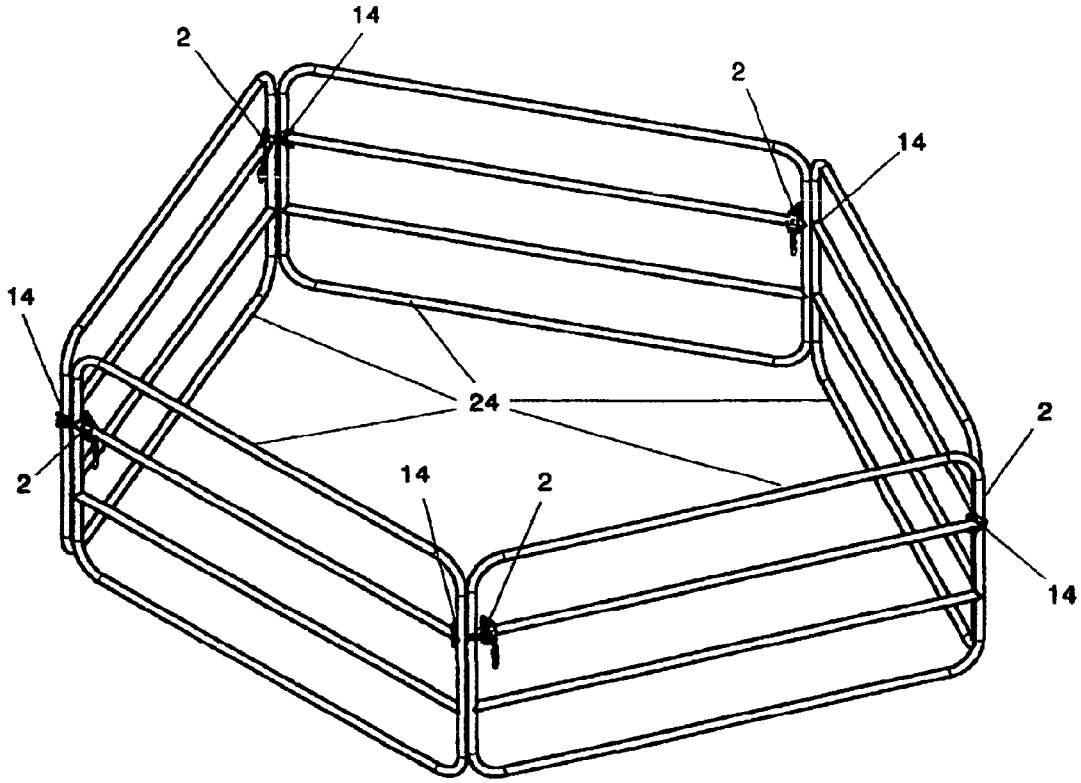
FIG. 6 shows the gate latch apparatus of this invention attached to a plurality of free-standing fence panels.

The gate latch apparatus of this invention can also be used with free-standing fence panels 24 shown in FIG. 6. Free standing fence panels lean against each other and form an enclosed area, thereby supporting each other. They have to be secured with one another and most commercial fence panels include welded pieces on the panel frame ends 26 that either slide or snap onto the next panel 24. The gate latch apparatus 2 of this invention is useful when fence panels 24 are placed on uneven ground and the provided locking systems fail to join up securely.

A collapsible livestock corral wherein a plurality of free-standing fence panels 24 are placed to support each other and are temporarily affixed together with a gate latch apparatus 2 that includes a pair of attachable, inflexible latch plates 4A, 4B that are mirror-images of each other with a center section of fitted metal that is connected to both a triangular member with an L-shaped slot 12 and rectangular member with a U-shaped slot 10 that is bolted to one of the bars of the fence panel 24 and is attached to an adjacent fence panel by insertion of a chain 14 into the outwardly-facing L-shaped slot 12 followed by the movement of the chain 14 into the inward-positioned section of the L-shaped slot 12 followed by movement of the chain 14 across the fitted member of the latch plate in a wrap-like manner and lastly movement of the chain into the U-shaped slot 10 of the rectangular member.

The collapsible livestock corral described above and made of free-standing fence panels 24 encloses livestock for a special purpose selected from the group consisting of vaccination, cleaning, worming, birthing, and other farm and ranching activities necessitating particular enclosure of livestock.

The collapsible livestock corral made of free-standing fence panels 24 are fixed in a geometric shape and one of the panels 24 acts as a gate opening.

SCOPE OF THE INVENTION

The above presents a description of the best mode contemplated of carrying out the present invention, and of the manner and process of using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention.

What is claimed is:

1. A gate latch for use in securing a gate to an object having a chain attached thereto, the latch comprising:

a bracket having first and second substantially inflexible latch plates, the second latch plate being a mirror image of the first latch plate, each latch plate having:

a first substantially-flat member having a U-shaped slot opening to a first side of said bracket and an aperture formed through said first substantially-flat member for receiving an elongate fastener, said U-shaped slot being adapted to receive a chain link;

a second, central member, having a contour adapted to match the contour of a mounting portion of a gate to which it may be attached; and a third, substantially-fiat triangular-shaped member having a first edge adjacent to said central member, a second edge extending away from said central member, and a hypotenuse edge extending from said first edge of said second bracket to said second edge of said second bracket, said third member having an L-shaped slot having two sections that are substantially perpendicular to one another, one said section opening at and being substantially perpendicular to said hypotenuse edge of said bracket and the second said section extending toward said second edge of, and terminating within, said third member, the L-shaped slot being adapted to receive a chain link, said third member having an aperture formed there through for receiving an elongate fastener, said aperture being disposed outwardly of said second L-shaped slot section with respect to said second, central member, between said second edge and said hypotenuse edge of said third member, such that said two latch plates may be placed on opposite sides of the mounting member of a gate and secured in place by elongate fasteners placed through respective said apertures in said first members and respective said apertures in said third members to clamp the two latch plates to said gate, and that a first link of the chain may be inserted into respective said L-shaped slots of said first and second latch plates and a second link of the chain may be inserted into respective said U-shaped slots of said first and second latch plates to secure to the gate to the object.

2. The gate latch of claim 1, wherein the U-shaped slot and the two sections of the L-shaped slot are about one inch long and about one-quarter inch wide.

3. The gate latch of claim 1, further comprising a chain whose length is within the range of about 12 inches to about 36 inches for attachment to the object and insertion into the slots of the latch plates.

4. The gate latch of claim 1, wherein the gate latch is adapted to removably mount a gate in either a horizontal or a vertical orientation.

5. The gate latch of claim 1, wherein the gate latch is made from a material selected from the list consisting of wood, plastic, galvanized metal, electroplated metal, and powder-coated metal.

6. The gate latch of claim 1, wherein the second, central, portion of each of the latch plates has an aperture formed therein to receive a fastener to secure the central fitted portion to the gate.

7. The gate latch of claim 6, further comprising a plurality of bolts for use as said fasteners.

* * * * *